US006073803A

United States Patent [19]

Sturm et al.

[11] Patent Number: 6,073,803

[45] Date of Patent: Jun. 13, 2000

[54] CONTAINER

[75] Inventors: Josef Sturm, Pischelsdorf; Augustin Schmuck, Klagenfurt, both of Austria

[73] Assignee: Plastikwerk Expan GmbH, Klagenfurt, Germany

[21] Appl. No.: 09/061,873

[22] Filed: Apr. 17, 1998

[51] Int. Cl.[7] ..... B67D 5/00; B67D 5/56; B65D 25/08

[52] U.S. Cl. ..... 222/80; 222/83; 222/129; 206/222

[58] Field of Search ..... 222/80, 83, 81, 222/83.5, 89, 90, 91, 420, 129; 215/DIG. 8; 206/219, 222

[56] References Cited

U.S. PATENT DOCUMENTS

| | | | |
|---|---|---|---|
| 3,802,604 | 4/1974 | Morane et al. | 222/83 |
| 4,610,374 | 9/1986 | Buehler | 222/83 |
| 4,646,947 | 3/1987 | Stull . | |
| 4,757,916 | 7/1988 | Goncalves | 222/83 |
| 4,982,875 | 1/1991 | Pozzi et al. | 222/83 |
| 5,186,323 | 2/1993 | Pfleger | 222/83 |

FOREIGN PATENT DOCUMENTS

| | | |
|---|---|---|
| 0 133 293 | 2/1985 | European Pat. Off. . |
| 0 230 195 | 7/1987 | European Pat. Off. . |
| 0 344 849 | 12/1989 | European Pat. Off. . |
| 0 356 758 | 3/1990 | European Pat. Off. . |
| 0 561 322 | 9/1993 | European Pat. Off. . |
| 0561322 | 9/1993 | European Pat. Off. . |
| 2 599 006 | 11/1987 | France . |
| 2599006 | 11/1987 | France . |
| 27 54 100 | 6/1978 | Germany . |
| WO 91/17930 | 11/1991 | WIPO . |
| WO 93/14990 | 8/1993 | WIPO . |

*Primary Examiner*—Kevin Shaver
*Assistant Examiner*—Keats Quinalty
*Attorney, Agent, or Firm*—Young & Thompson

[57] ABSTRACT

A container (1) with two receiving spaces (3, 5) for liquids that are to be mixed only just prior to use has a bottle-shaped lower part (2) with first receiving space (3) and an upper part (4) which can be mounted on lower part (2) and has a second receiving space (5). Second receiving space (5) is connected to receiving space (5) of lower part (2) by an opening, which is initially closed by a diaphragm (20) or a closure plug (35) and is opened only just before the mixed liquids are to be used. To do this, diaphragm (20) is slit by a cutting edge (36) corresponding to closure top (10). If the opening is closed by a stopper-shaped closure (35), closure top (10) has a plunger (40) for pushing closure plug (3) out. Both cutting edge (36) and plunger (40) are connected to the closure top so that they can be activated by a screwing motion of closure top (10). The parts of container (1) according to the invention, namely lower part (2) and upper part (4), can be connected together by a screw connection or a snap connection.

30 Claims, 7 Drawing Sheets

10
4
2

10
43
39
41
41
11
4
51
16
2
35

10
41
41
39
5
32
22
4
16
2
35
50
17

CONTAINER

CROSS REFERENCE TO RELATED APPLICATIONS

This application corresponds to Austrian application A 2043/97 of Dec. 2, 1997 and Austrian application A 366/98 of Mar. 3, 1998, the disclosures of which are incorporated herein by reference.

FIELD OF THE INVENTION

The invention pertains to a container used in, e.g., the cosmetics field when two substances are to be mixed together immediately before use.

SUMMARY OF THE INVENTION

The object of the invention is to provide such a container with two receiving spaces for liquid media that are initially to be stored separately and that are to be mixed together before use, whereby said container has as simple a structure as possible, which consists of as few individual parts as possible and which, after the liquid media are mixed, makes it possible to readily apply the mixture wherever it is needed.

Various details, features, and advantages of the container according to the invention are indicated by the following description of preferred sample embodiments.

BRIEF DESCRIPTION OF THE DRAWINGS

FIGS. 17 and 18 show details on an enlarged scale.

Figure 1:
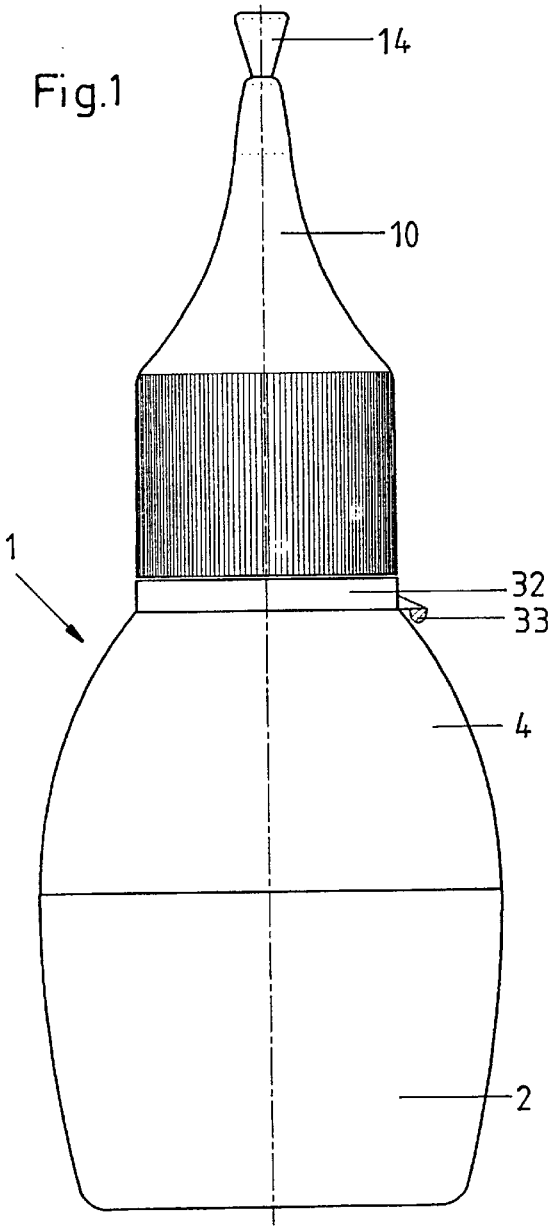
FIGS. 1–3 show a first embodiment of a container in three views.
Figure 2:
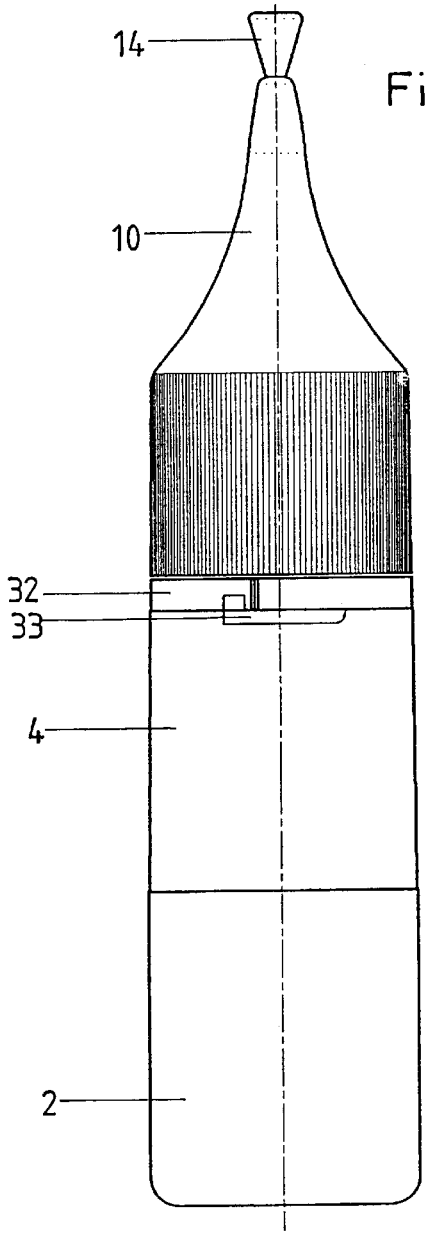
Figure 3:
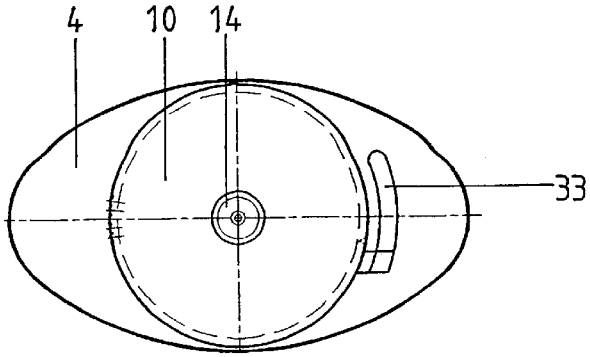
Figure 6:
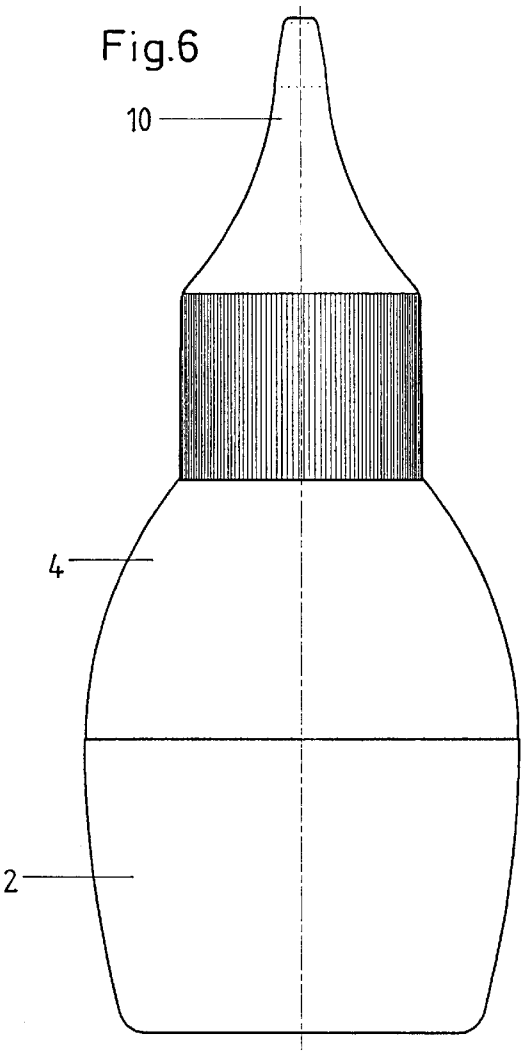
FIG. 6 shows a view of the container that is depicted in section in FIG. 5.

In the case of the embodiment shown in FIGS. 1–6 of a container 1 according to the invention, said container consists of a bottle-shaped lower part 2, in which first receiving space 3 is accommodated, and an upper part 4 which is mounted on lower part 2 in which second receiving space 5 for a liquid medium is accommodated. The interior space of bottle-shaped lower part 2 serves as first receiving space 3 for receiving a liquid medium 6. Receiving space 5 in upper part 4 receives second liquid medium 7.

On upper part 4 that contains second receiving space 5, threaded top 10 is screwed onto a hollow tube-like connection piece 11 by means of threading 12. In the area of its discharge opening 13, threaded top 10 is closed by, e.g., closure part 14, which may be separable but preferably is integral with threaded top 10. Connection piece 11, onto which closure top 10 is screwed, is accommodated with its lower end 15 in neck 16 at upper end wall 17 of bottled-shaped lower part 2 and is closed there by means of a diaphragm 20 so that receiving space 5 in upper part 4 of container 1 is separated from receiving space 3 in lower part 2 of container 1 and liquid media 7 and 6 cannot mix together.

From connection piece 11 a bell-shaped wall part 22 extends downward, whose free edge 23 is connected by means of, e.g., a snap connection 24 to wall 25 of lower part 2 in the area of a shoulder 26 that projects inward and is located in the area between side wall 25 and upper end wall 17. In this way lower part 2 is connected to upper part 4 of container 1.

DESCRIPTION OF THE PREFERRED EMBODIMENTS

Between lower free edge 30 of threaded top 10 and a ring surface 31 of bell-shaped wall 22 of upper part 4, which surface is essentially perpendicular to tube-shaped connection piece 11, there is a guarantee ring 32, which can be removed by pulling on a pull tab 33.

At shoulder 26, snap connection 24 between upper part 4 and lower part 2 of container 1 has an outward-projecting ring grip at wall 25 of lower part 2 and an inward-point ring grip in the area of the free edge of bell-shaped wall part 22 of upper part 4. When upper part 2 and lower part 4 are connected to one another, the free edge of wall part 22 rests on the inward-pointing wall area of shoulder 26, and the rib at wall part 22 grips under the rib at wall 25 of lower part 2. This provides a simple snap connection 24.

Figure 5:
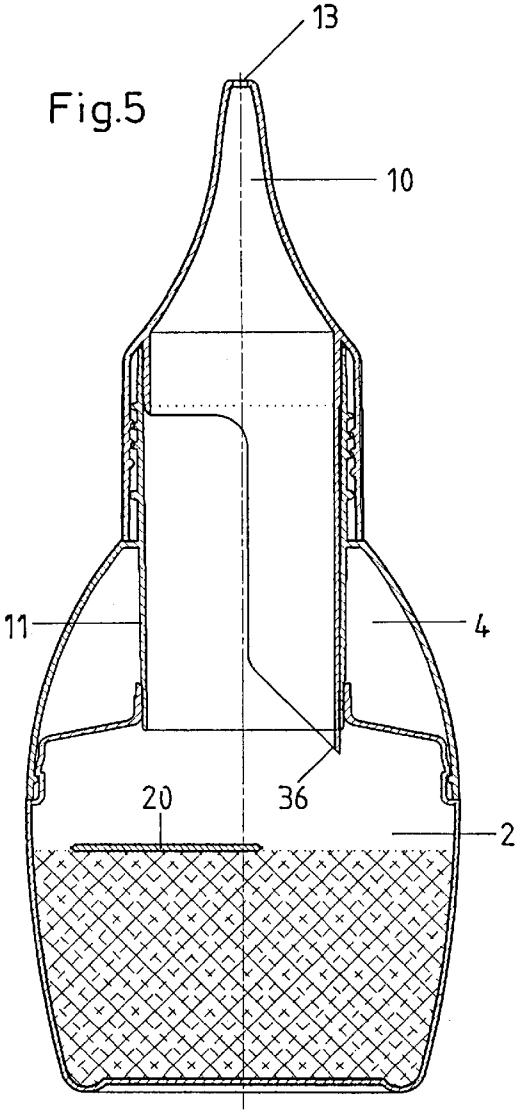
FIG. 5 shows a section similar to that of FIG. 4, where the two receiving spaces are connected together and the discharge opening at the top is open.
Figure 4:
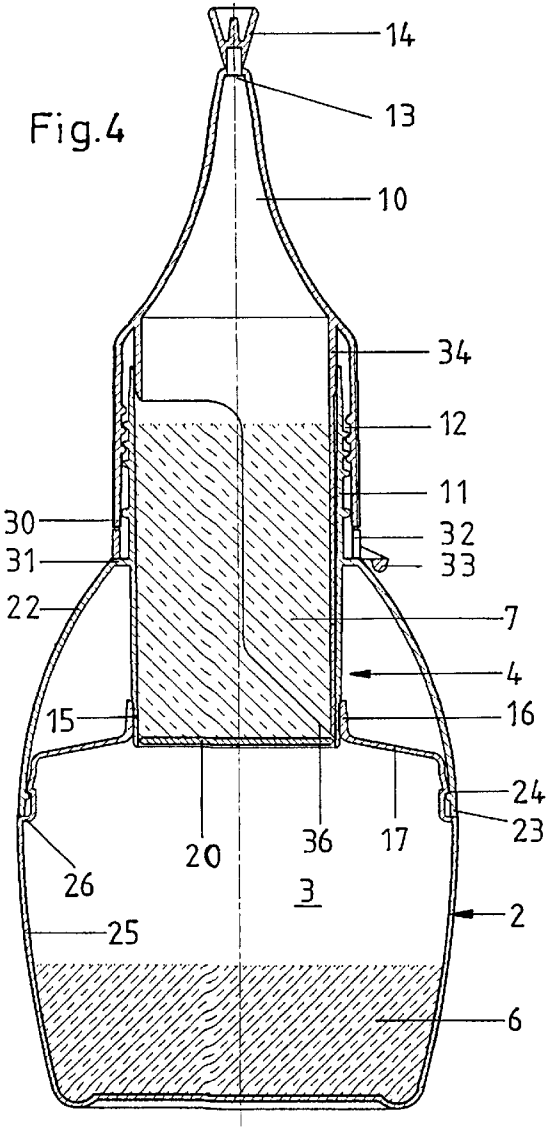
FIG. 4 shows a longitudinal section of the container depicted in FIGS. 1–3.

Closure top 10 has an inward-projecting, hollow, cylindrical lug 34 that is housed inside connection piece 11 of upper part 4 and preferably rests with its outer surface on the inner surface of connection piece 11. In the longitudinal direction, lug 34 is interrupted at least once, e.g., by at least one longitudinal slot. The free, downward-putting edge of lug 34 is designed as cutting edge 36 which, in the position of container 1 shown in FIG. 4 in which two receiving spaces 3 and 5 are not yet connected, is arranged to correspond to diaphragm 20 that separates receiving spaces 3 and 5. Guarantee ring 32, which is located between its free, lower edge 30 and shoulder 31 in wall 32 of upper part 4, keeps closure top 10 from being accidentally moved downward, e.g., by a screwing motion of top 10. Only after guarantee ring 32 is removed (pulled off) can cutting edge 36 of closure top 10, which is initially arranged right next to (above) diaphragm 20, be lowered by downward screwing of closure top 10, so that diaphragm 20 is detached all the way around from connection pieces 11 that bound second receiving space 5. At this point receiving spaces 3 and 5 are in connection with one another, and the liquid media contained therein can be mixed together. This position is shown in FIG. 5.

In order to make it easier to separate diaphragm 20 with cutting edge 36 at lug 34, a creasing line (thinning of material) can be provided at the edge of diaphragm 20, i.e., where cutting edge 36 is applied.

After closure part 14 at discharge opening 13 of top 10 is separated, the mixed medium can be poured out of first and second receiving spaces 3 and 5, which are not connected together, or be squeezed out by elastic deformation of lower part 2 of container 1.

Figure 7:
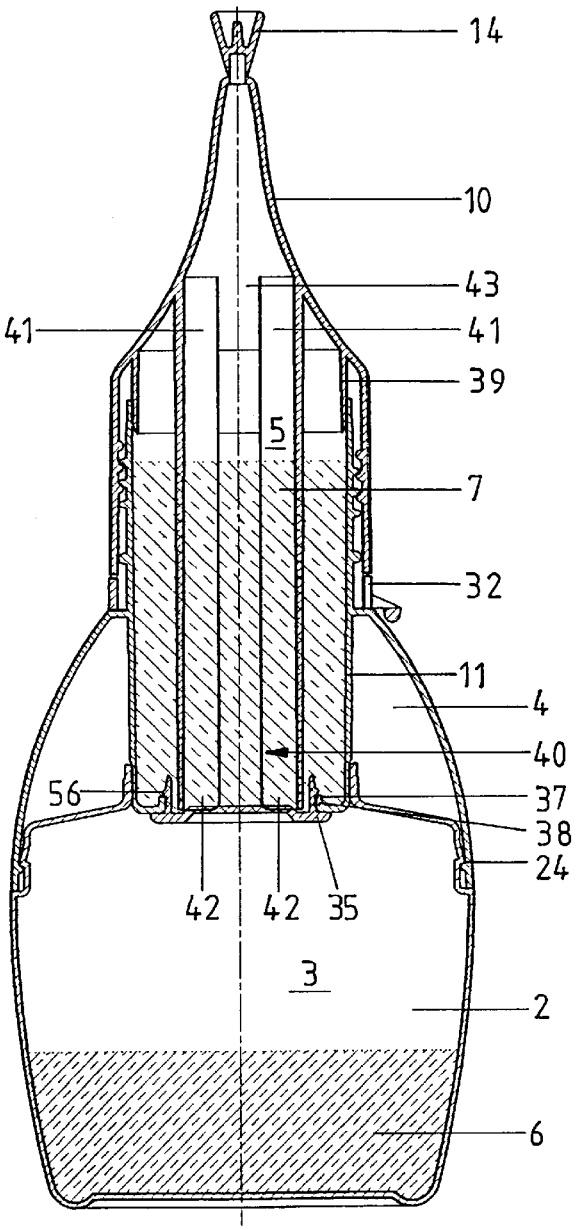
FIG. 7 shows another embodiment of a container in a section similar to that in FIG. 4.
Figure 8:
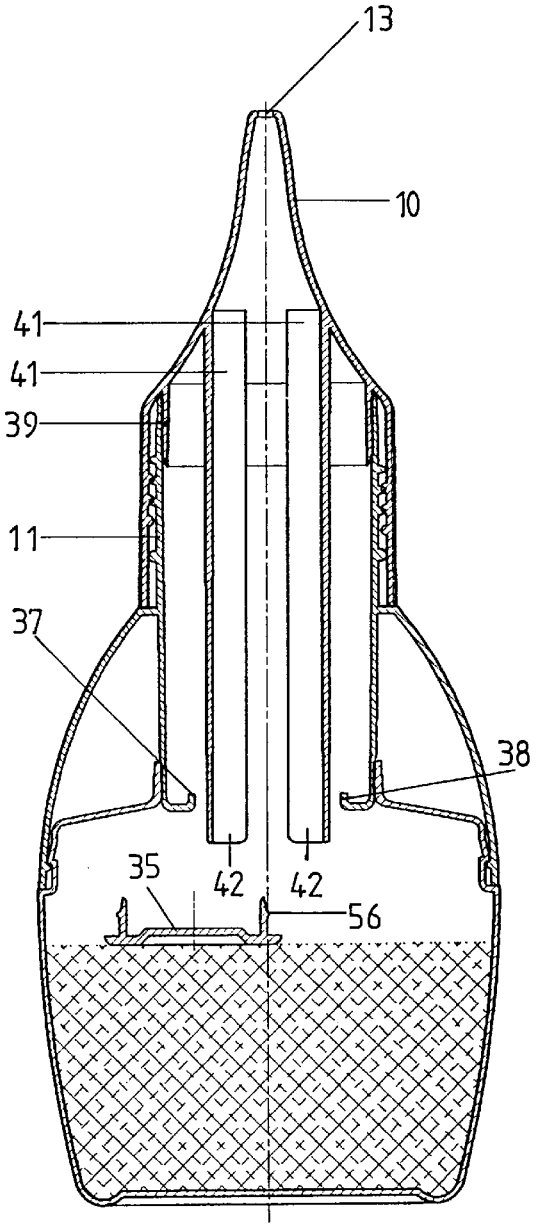
FIG. 8 shows the container from FIG. 7 after the closure element that separates the two receiving spaces has been opened.
Figure 9:
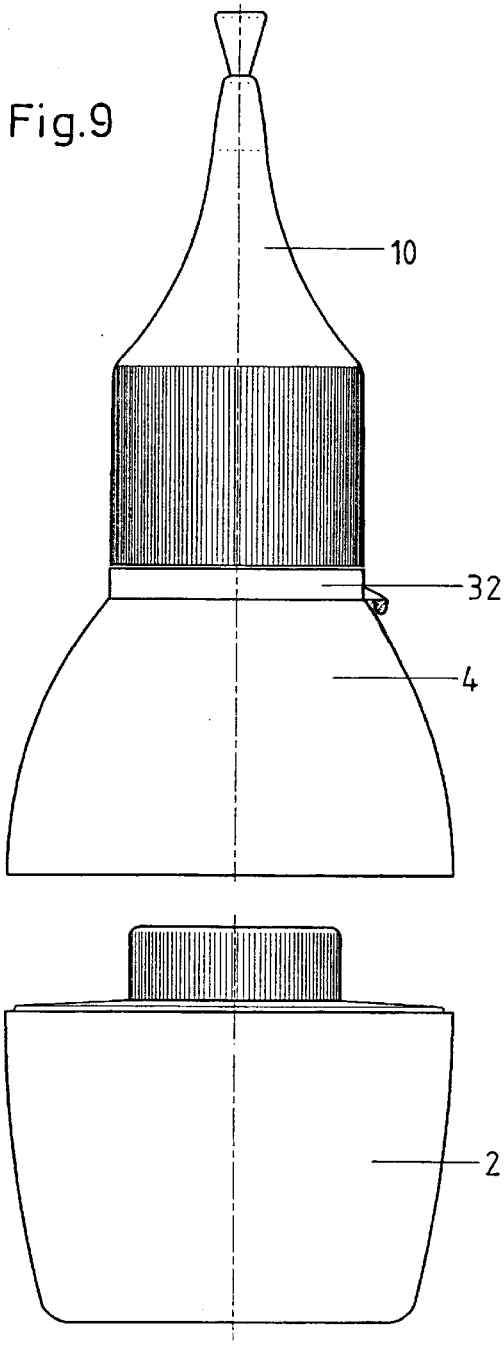
FIG. 9 shows a third embodiment of container whereby the upper and lower parts are shown separated from one another and not yet connected together.
Figure 10:
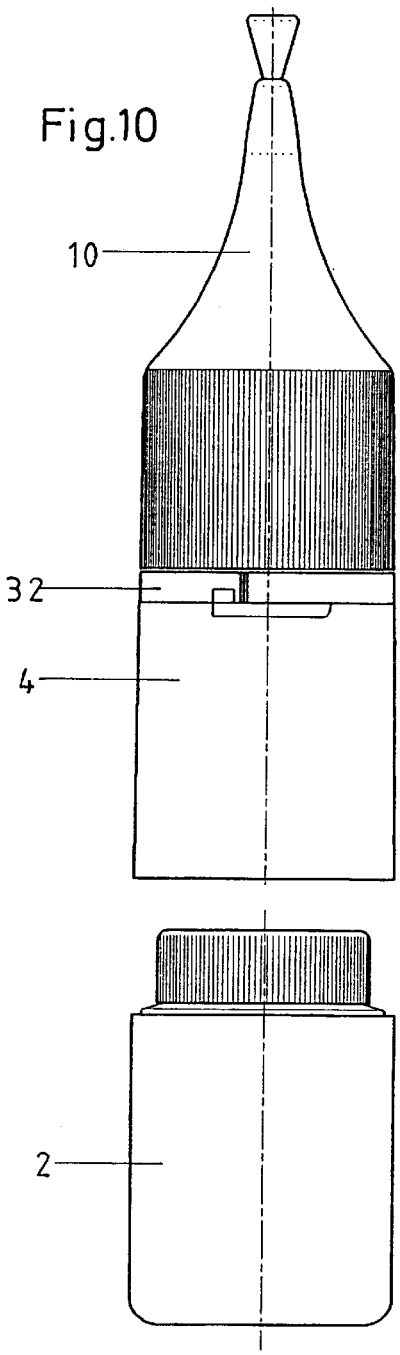
FIG. 10 shows a corresponding side view.
Figure 11:
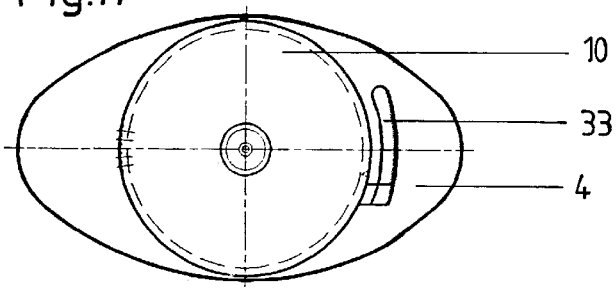
FIG. 11 shows a top view of FIGS. 9 and 10.

The embodiment shown in FIGS. 7 and 8 corresponds to a very large extent to that shown in FIGS. 1–6, with the exception that two receiving spaces 3 and 5 are separated not by a diaphragm, but rather by a closure element 35 such as a plug. Closure element 35 is inserted into the lower end of connection piece 11 in upper part 4 and is held there by an outer rib 56, which grips over upward-pointing end 37 of wall 38 which bounds the opening. Instead of a through rib 36, there may also be several holding projections. Closure element 35 may also be a full stopper made of a (rubber)-elastic material.

In order to be able to force closure element 35 out of its position that separates receiving spaces 3 and 5 from one other, at closure 10 there is a (hollow) plunger 40 which, in the sample embodiment shown, has two (or more) wall parts 41 which are arc-shaped in cross-section and whose free ends 42, in the position shown in FIG. 7 (receiving spaces 3 and 5 are separated from one another), rest on the surface of closure element 35 that points toward receiving space 5 or are arranged just above it. After guarantee ring 32 is removed, closure 10 can be moved downward by a screwing motion, whereby, as shown in FIG. 8, closure element 35 can be forced out of the lower opening of connection piece 11 that bounds second receiving space 5 and the liquid media contained in receiving spaces 3 and 5 can be mixed together. Subsequent handling is similar to that in FIGS. 1–6, whereby it should also be pointed out that plunger 40 at closure top 10, which corresponds to closure element 35, does not prevent pouring since there are through slots 43 between its wall parts 41.

In order to ensure that closure element 35 is not accidentally forced out of connection piece 11 when there is overpressure in receiving space 5, it may be provided that at the free end of plunger 40 there is a support, e.g., a ring that from the inside rests on the inner surface of the upward-pointing ring wall of closure element 35. This keeps rib 56 from accidentally becoming detached from end 37.

In order to ensure precise guidance of closure top 10 at connection piece 11, which is equipped with external threading, there is a cylindrical lug 39, which projects downward from the outer wall of closure top 10 and is guided at the inner surface of connection piece 11 of upper part 4. Said lug 39 is also an additional seal for receiving space 5.

The embodiment of container 1 that is shown in FIGS. 9–14 corresponds to the embodiment shown in FIGS. 7 and 8, except for the differences described below. In order to connect bottle-shaped lower part 2 to upper part 4 which holds second receiving space S, there is an extension 50, which has internal threading, at the upper end of the wall of connection piece 11 that bounds second receiving space 5 laterally. Extension 50 may be screwed onto neck 16 of bottle-shaped lower part 2 with the aid of external threading. Outer wall 22 of lower part 2 rests with its free edge in the edge area of upper wall 17 of the lower part, in the shape of a molded-in, ring-shaped step.

Figures 12, 13, 14:
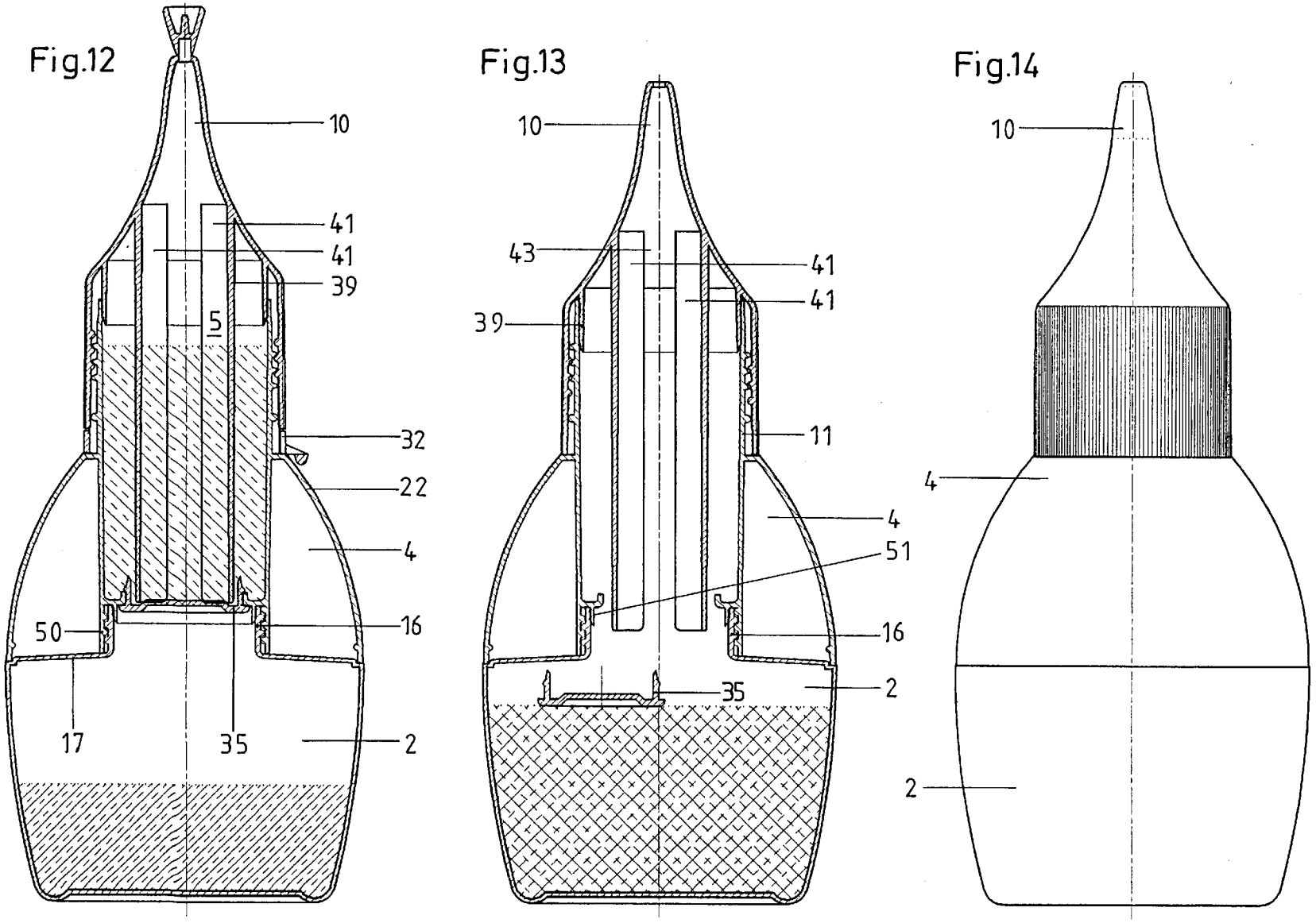
FIG. 12 shows a section similar to that in FIG. 4 through the container depicted in FIGS. 9–11.
FIG. 13 shows a section similar to that in FIG. 12 with the closure opened and with the contents of the receiving spaces mixed.
FIG. 14 shows a view of the container depicted in FIG. 13.

In the embodiment shown in FIGS. 9–14, at the downward-pointing, lower edge of connection piece 11, parallel 45 to extension 50 of it which has internal threading, there is a ring flange 51, which grips into neck 16 of lower part 2 when lower part 2 is connected to upper part 4, as shown in FIGS. 13 and 12.

It should be pointed out that in the embodiment shown in FIGS. 9–14, instead of plunger 40 for forcing closure element 35 out of the lower end of connection piece 11 when there is a diaphragm 20 at the lower end of connection piece 11, as shown in the embodiment according to FIGS. 1–6, there can be a cutting device (cutting edge 36) that is connected to closure top 10 and that is designed for slitting open diaphragm 20, i.e., for connecting two receiving spaces 3 and 5.

In the case of the embodiment shown in FIGS. 9–13 as well, closure top 10 can be moved only after guarantee ring 32 has been removed.

The embodiment shown in FIGS. 9–14 has the advantage (see FIGS. 9 and 10) that lower part 2 is also closed by a closure top screwed over its neck 16 if upper part 4 is not mounted. This makes it possible, e.g., in a business, to combine lower parts 2 and upper parts 4 that are filled with liquid media as needed or desired by selecting corresponding upper parts 4 and lower parts 2 that are filled with liquid media and connecting the two parts of container 1 together by removing the threaded top from lower part 2 by screwing on upper part 4. This can be done without mixing liquid media 6 and 7 in lower part 2 and in upper part 4 since receiving space 5 with liquid medium 7 of upper part 4 is closed by closure element 35 or optionally provided diaphragm 20 and is opened only after closure top 10 is screwed down by virtue of the fact that closure element 35 is forced out of the lower end of connection piece 11 or the diaphragm located at the lower end of connection piece 11 is slit open. In addition, the embodiment shown in FIGS. 9–14 can be provided for sale as a finished unit, namely as container 1 with connected lower part 2 and upper part 4.

The embodiment according to FIGS. 1–8 also offers the possibility of combining container parts (lower part 2, upper part 4) that are filled with different media. In that case a top can be placed (snapped) onto neck 16 of lower part 2, whereby said top is removed before a lower part 2 is connected to an upper part 4.

Since certain bulk goods tend to create an over-pressure, emphasis is placed on an embodiment of the invention in which the venting of space 5 and pressure equalization are automatically ensured while closure top 10 is being screwed down (after guarantee ring 32 is pulled off).

Figure 15:
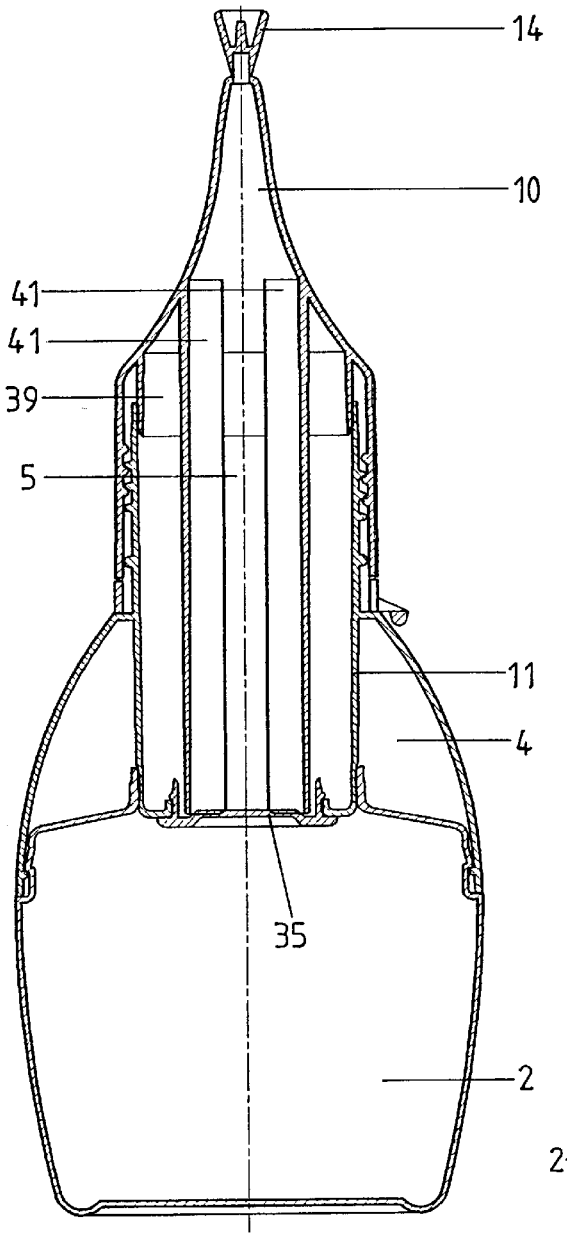
FIG. 15 depicts a container which is designed similar to that shown in FIGS. 7 and 8.

One embodiment is shown in FIGS. 15–18, as it can look in detail. FIG. 15 shows a container which is designed similar to that shown in FIGS. 7 and 8. The reader is therefore referred to the description of the embodiment shown in FIGS. 7 and 8.

In the case of the embodiment shown in FIGS. 15–18, there are two sealing surfaces 60 and 61 on the outside of lug 39, which projects inward from the upper part of closure top 10 and which grips into connection piece 11 of upper part 4. Between sealing surfaces 60 and 61 there is at least one of outward-projecting rib 62 that is located at the outside of lug 39 and that extends between two sealing surfaces 60 and 61. Rib 62, which is located between sealing surfaces 60 and 61, can have an arbitrary cross-section and may be higher in the direction from sealing surface 60, which is located in the area of the free end of lug 39, toward sealing surface 61, which is located at the other end of lug 39. In practice there are, e.g., four such ribs 62 on the outside of lug 39, distributed around its periphery.

Figure 17:
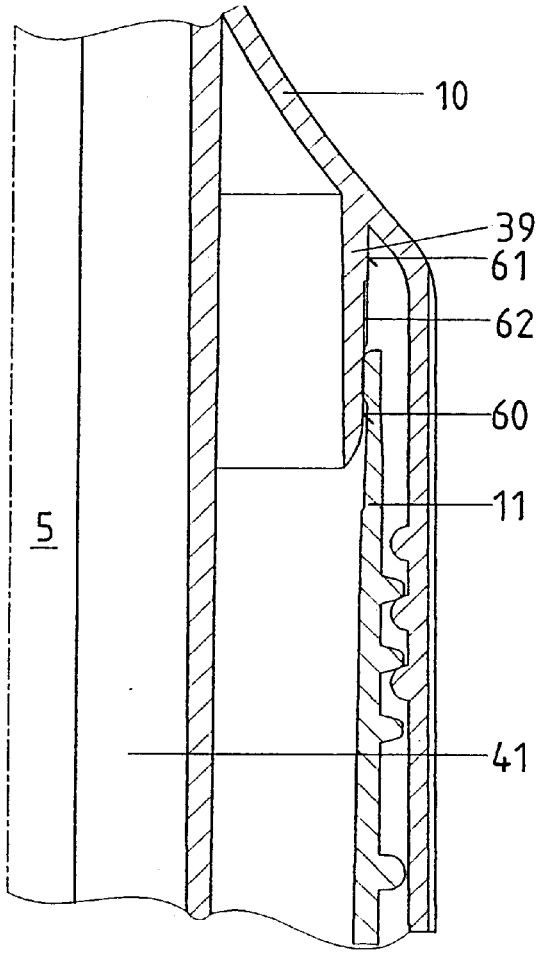

In the initial position shown in FIGS. 15 and 17, lug 39 rests with its sealing surface 60 flat, i.e., flush, against the upper edge of the inside of connection piece 11. After guarantee strip 32 is removed, closure top 10 is screwed down onto container 4, whereupon bridges 62 (ventilation bridges) that are located in the connection to sealing surface 60, come into the area of the end of connection piece 11 and then expand said piece until it grows into the shape of a wedge, to such an extent that between bridges 62 at least one passage is opened that makes it possible to equalize the pressure between space 5 and its surroundings. Only when it is completely screwed on, i.e., when sealing surface 61, which is located in the area of lug 39, is connected via said lug to closure 10, comes into the area of the free end of connection piece 11, will sealing again be ensured by sealing surface 61.

In this process it may be provided that the diameter of sealing surface 60 be smaller than that of sealing surface 61 and that at least one (ventilation) bridge 62, which is triangular in cross-section or is rounded off or has a rectangular cross-section, becomes higher from sealing surface 60 towards sealing surface 61.

The same effect of ventilation and pressure equalization can be achieved if in the outer side of lug 39 there is at least one groove that extends between sealing surfaces 60 and 61.

Figure 16:
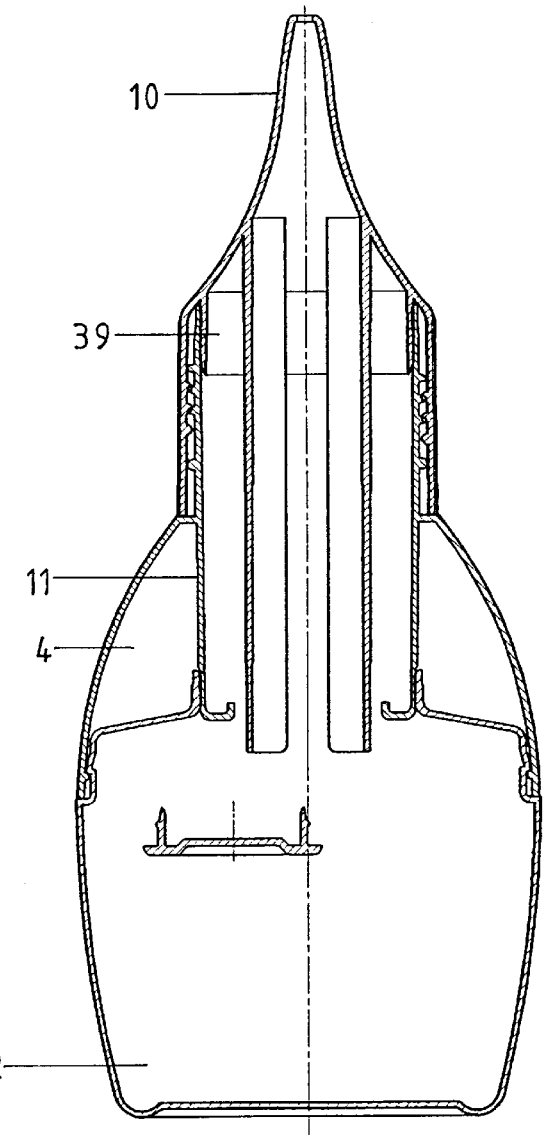
FIGS. 16 and 17 view of the container depicted in FIG. 13, FIGS. 16 and 17 show an embodiment with ventilation in various positions.
Figure 18:
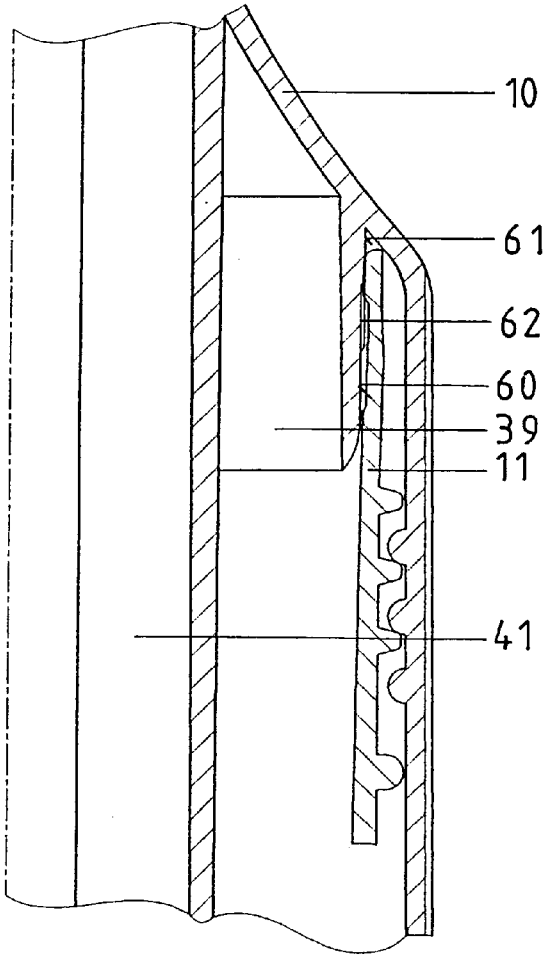

FIGS. and 17 and 18 shown the embodiment of the container according to the invention, as depicted in FIGS. 15 and 16, on an enlarged scale, whereby it is clear that initially sealing surface 60, which is located in the area of the free end of lug 39, works with the free edge of connection piece 11 (FIG. 17) and that, after closure top 10 is screwed down, sealing surface 61 of lug 39 works with the free edge of connection piece 11 to form a seal (FIG. 18). Also one of bridges 62, which are essential for equalizing pressure for the passages between lug 39 and connection piece 11, is shown.

In summary, a preferred embodiment of the container according to the invention can be described as follows:

A container 1 with two receiving spaces 3, 5 for liquids that are to be mixed only just before use has a bottle-shaped lower part 2 with first receiving space 3 and an upper part 4, which can be mounted on lower part 2 and has second receiving space 5. Second receiving space 5 is connected to receiving space 5 of lower part 2 by an opening which is initially closed by a diaphragm 20 or a closure plug 35 as well and which is opened only immediately before the mixed liquid are to be used. To accomplish this, diaphragm 20 is slit by a cutting edge 36 corresponding to closure 10. When the opening is closed by a plug-shaped closure 35, closure top 10 has a plunger 40 to force closure plug 35 out. Both cutting edge 36 and plunger 40 are connected to the closure top so that they can be activated by a screwing motion of closure top 10.

The parts of container 1 according to the invention, namely lower part 2 and upper part 4, can be connected together by a screw connection or by a snap connection 24.

What is claimed is:

1. Container with two receiving spaces for liquid media which are initially to be stored separately from one another, and which are to mixed with one another before use, the container comprising;

a bottom part having a closed first end, an open neck at an opposite second end, and defining a first receiving space for storing a first liquid medium, said bottom part being bottle-shaped and having a wall which terminates at an upper end at the neck;

an upper part comprising a tubular-shaped connection piece having a lower end closed by a partition means and adapted to fit into the neck of the bottom part, and an opposite upper end; said connection piece defining a second receiving space for storing a second liquid media, said neck resting against an outer surface of the lower end, said connection piece having a bell-shaped wall part projecting therefrom, said bell-shaped wall part having a free edge which is connected to the wall of the lower part of the container;

said upper part being separate from said bottom part; and a closure top extending in a longitudinal direction, and having a first end adapted to fit over the upper end of the connection piece, a discharge opening at an opposite second end for discharging mixed media, and including means for creating a connecting opening for liquid communication between the two receiving spaces.

2. Container according to claim 1, wherein the closure top has internal threading for screwing onto the connection piece.

3. Container according to claim 1, wherein the partition means is a diaphragm.

4. Container according to claim 3, wherein the closure top comprises a tube-shaped lug having at least one slot and whose free end has a cutting edge for cutting the diaphragm.

5. Container according to claim 4, wherein the lug that has the cutting edge has an outer surface which is guided so as to rest on an inner surface of the connection piece.

6. Container according to claim 4, further comprising a removable guarantee ring positioned between a wall part which projects laterally from the connection piece and a free edge of the closure top.

7. Container according to claim 6, wherein the guarantee ring has a pull tab.

8. Container according to claim 4, wherein the cutting edge is located directly adjacent the membrane near the guarantee ring which is located between the closure top and the wall part.

9. Container according to claim 1, wherein the partition means is a closure plug, and disposed in the connection piece is a plunger, whose free end corresponds to the closure plug.

10. Container according to claim 9, wherein the plunger consists of at least two curved wall parts having at least one slot therebetween.

11. Container according to claim 9, wherein the closure plug has a ring-shaped lug that grips into the opening at the lower end of the connection piece.

12. Container according to claim 11, wherein on the outside of the ring-shaped lug of the closure plug there is an outward-pointing ring grip which, when the closure plug is in place, grips a free edge of a wall part of the connection piece that bounds the connecting opening.

13. Container according to claim 9, further comprising a sleeve between an outer wall of the closure top and the plunger, said sleeve adapted to rest against an inner surface of the connection piece.

14. Container according to claim 9, further comprising a removable guarantee ring positioned between a wall part which projects laterally from the connection piece and a free edge of the closure top.

15. Container according to claim 14, wherein the guarantee ring has a pull tab.

16. Container according to claim 14, wherein the free end of the plunger is located directly adjacent to the closure plug near the guarantee ring, which is located between the closure top and the wall part.

17. Container according to claim 1, wherein the upper part is connected to the lower part by a snap connection.

18. Container according to claim 1, wherein the upper part is connected to the lower part via the bell-shaped wall part.

19. Container according to claim 1, further comprising a snap connection arranged at the free edge of the bell-shaped wall part of the upper part, and at the upper end of the wall of the lower part.

20. Container according to claim 1, wherein the neck has external threading and the lower end of the connection piece has an extension for connection to the neck.

21. Container according to claim 20, wherein the neck and the extension are connected together by threading.

22. Container according to claim 20, further comprising a ring grip projecting from the lower end of the connection piece in the same direction as the extension, the ring grip resting against the inside of the neck of the lower part.

23. Container according to claim 1, wherein the discharge opening is closed by a separate closure part.

24. Container according to claim 1, wherein the closure top includes a lug having on an outer surface, at least one elevation or depression which interacts with the connection piece, whereby when the closure top is partly screwed down, a connection is created between an inner space of the upper part and surroundings.

25. Container according to claim 24, wherein the outer surface of the lug comprises a first sealing surface and a second sealing surface, the first sealing surface interacting with the connection piece of the container in a first position of the closure top, and the second sealing surface interacting with the connection piece in a second position of the closure top.

26. Container according to claim 25, wherein said at least one depression comprises at least one groove which extends between the sealing surfaces.

27. Container according to claim 25, wherein the lug has a free edge, and the diameter of the first sealing surface at the free edge of the lug is smaller than the diameter of the second sealing surface which is located in a transition area between the lug and the closure top.

28. Container according to claim 24, wherein elevations or depressions extend in the longitudinal direction of the closure top between the sealing surfaces.

29. Container according to claim 24, wherein said at least one elevation comprises at least one bridge which extends in the longitudinal direction of the closure top.

30. Container according to claim 29, wherein the bridge which projects outwardly is higher from the first sealing surface toward the second sealing surface.

* * * * *

UNITED STATES PATENT AND TRADEMARK OFFICE

CERTIFICATE OF CORRECTION

PATENT NO. : 6,073,803

DATED : June 13, 803

INVENTOR(S) : Josef Sturm, et. al.

It is certified that error appears in the above-indentified patent and that said Letters Patent is hereby corrected as shown below:

Title page, item [54] and col. 1, should read --CONTAINER FOR MIXING LIQUID MEDIA BEFORE USE--

Also, on the title page, insert Item [30] as follows:

--[30] Foreign Application Priority Data

| | | |
|---|---|---|
| **December 29, 1997** | **[AU]** | **Austria.....A 2043/97** |
| **March 3, 1998** | **[AU]** | **Austria.....A 366/98--.** |

Signed and Sealed this

Twentieth Day of March, 2001

Nicholas P. Godici

*Attest:*

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,073,803
DATED : June 13, 2000
INVENTOR(S) : Josef Sturm et al.

It is certified that error appears in the above-identified patent and that said Letters Patent is hereby corrected as shown below:

Title page, and column 1,Line 1,
Amend Item [54] to read as follows, --[54] CONTAINER FOR MIXING LIQUID MEDIA BEFORE USE --.
Insert item [30] as follows, -- [30] Foreign Application Priority Data

| | | |
|---|---|---|
| **December 2, 1997** | **[AU]** | **Austria.....A 2043/97** |
| **March 3, 1998** | **[AU]** | **Austria.....A 366/98** |

This certificate supersedes certificate of correction issued March 20, 2001.

Signed and Sealed this

Ninth Day of October, 2001

*Attest:*

Nicholas P. Godici

*Attesting Officer*

NICHOLAS P. GODICI
*Acting Director of the United States Patent and Trademark Office*